US008348531B2

(12) United States Patent
Godden et al.

(10) Patent No.: US 8,348,531 B2
(45) Date of Patent: Jan. 8, 2013

(54) MEDIA TREATMENT WEB FLOW PATH

(75) Inventors: John W. Godden, San Diego, CA (US); Paul C. Ray, San Diego, CA (US); Jaren D. Marier, Escondido, CA (US); Mun Yew Lee, San Diego, CA (US); Paul D. Rauscher, Green Bay, WI (US); Robert J. Manders, DePere, WI (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1085 days.

(21) Appl. No.: 12/258,762

(22) Filed: Oct. 27, 2008

(65) Prior Publication Data

US 2009/0297245 A1 Dec. 3, 2009

Related U.S. Application Data

(60) Provisional application No. 61/056,435, filed on May 27, 2008.

(51) Int. Cl.

| | |
|---|---|
| ***B41J 15/04*** | (2006.01) |
| ***B65H 23/32*** | (2006.01) |
| ***F26B 13/08*** | (2006.01) |

(52) U.S. Cl. ..... 400/611; 101/424.1; 34/147

(58) Field of Classification Search ..... 347/102; 400/611; 34/147, 647, 616, 620; 101/424.1; *F26B 13/08; G03D 15/02*

See application file for complete search history.

(56) References Cited

U.S. PATENT DOCUMENTS

| | | | | |
|---|---|---|---|---|
| 772,695 | A | * | 10/1904 | Crowell ..... 118/65 |
| 967,076 | A | * | 8/1910 | Spenle ..... 34/78 |
| 1,315,377 | A | * | 9/1919 | McGiehan ..... 101/152 |
| 1,834,147 | A | * | 12/1931 | Dausmann ..... 101/424.1 |
| 2,103,110 | A | * | 12/1937 | Dickhaut et al. ..... 34/647 |
| 2,462,032 | A | | 2/1949 | Wolf |
| 3,084,449 | A | * | 4/1963 | Huffman ..... 34/647 |
| 3,239,948 | A | * | 3/1966 | Di Mino ..... 34/657 |
| 3,750,305 | A | * | 8/1973 | Loser ..... 34/573 |
| 4,102,058 | A | * | 7/1978 | Foster, Sr. ..... 34/629 |
| 5,447,566 | A | | 9/1995 | Loiacono |
| 6,178,883 | B1 | | 1/2001 | Satoh et al. |
| 7,073,439 | B2 | | 7/2006 | Takahashi et al. |
| 2006/0021245 | A1 | | 2/2006 | Schneider et al. |
| 2007/0235923 | A1 | | 10/2007 | Keller |

FOREIGN PATENT DOCUMENTS

| | | | |
|---|---|---|---|
| JP | 2003170573 | A * | 6/2003 |
| JP | 2005335145 | A * | 12/2005 |
| RU | 2151986 | C1 * | 6/2000 |

* cited by examiner

*Primary Examiner* — Daniel J Colilla

(57) ABSTRACT

Various embodiments and methods relating to moving a printed upon web along bowed segments of a web path through at least three consecutive turns in a same direction are disclosed.

14 Claims, 5 Drawing Sheets

MEDIA TREATMENT WEB FLOW PATH

CROSS-REFERENCE TO RELATED PATENT APPLICATIONS

This Application claims the benefit of provisional patent application Ser. No. 61/056,435, filed May 27, 2008, titled "WEB FLOW PATH", which application is incorporated by reference herein as if reproduced in full below.

The present application is related to U.S. patent application Ser. No. 12/251,968 filed on Oct. 15, 2008 which claims priority from U.S. Provisional Patent Application Ser. No. 60/987,026 filed on Nov. 9, 2007 by Paul C. Ray; Neil Doherty; Mun Yew Lee; Thomas J. Tarnacki; Jaren D. Marier; Robert J. Manders; and John W. Godden and entitled WEB FLOW PATH, the full disclosure of which is hereby incorporated by reference.

BACKGROUND

Printing Systems may print and dry images on a web of media. The printed image is sometimes contacted and damaged prior to being dried. In addition, some printers may occupy relatively large amount of floor space.

DETAILED DESCRIPTION OF THE EXAMPLE EMBODIMENTS

Figure 1:
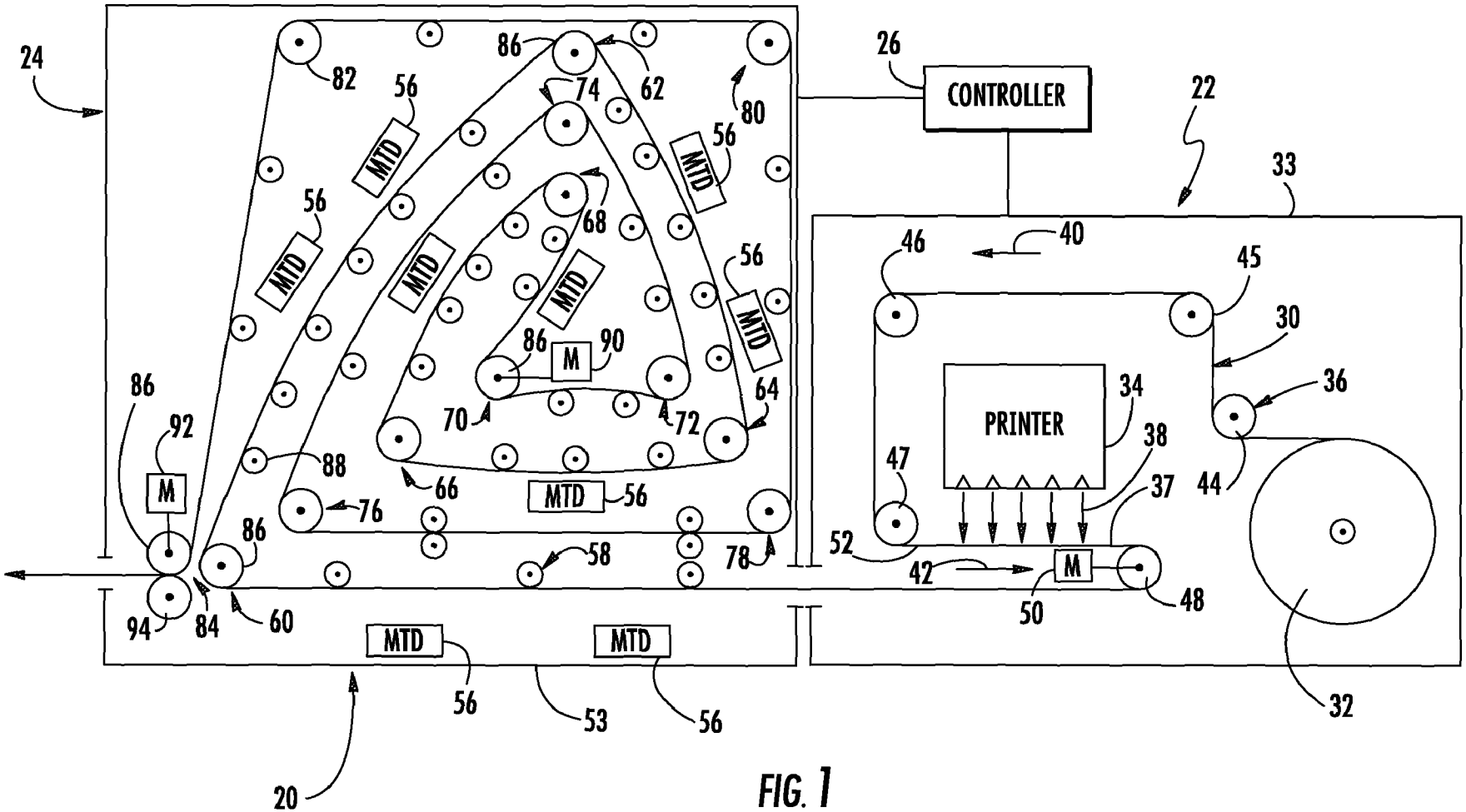
FIG. 1 is a schematic illustration of a printing system according to an example embodiment.

FIG. 1 schematically illustrates a printing system 20 according to an example embodiment. Printing system 20 is configured to print upon a web of print media. Printing system 20 further provides a compact web flow path that provides greater time for treating the printed image on the web of media to a more permanent or robust state prior to the printed image being contacted.

System 20 includes print module 22, fixer module 24 and controller 26. Print module 22 selectively deposits printing material upon web 30 to form an image, pattern, layout or arrangement of printing material upon web 30. In one embodiment, web 30 comprises a web of printing material such as a cellulose-based media. In another embodiment, web 30 may comprise a web of polymeric material. In yet another embodiment, web 30 may comprise one or more materials. As shown by FIG. 1, in the example illustrated, web 30 is provided from a supply roll 32. In one embodiment, the printing material comprises a fluid such as one or more inks. In another embodiment, the printing material may comprise a liquid toner or other types of fluid.

Print module 22 includes housing 33, a printer device or printer 34 and web flow path 36. Housing 33 comprises a framework supporting printer 34 and web path 36. Housing 33 further encloses printer 34 and web flow path 36. Housing 33 may have multiple configurations. In other embodiments, a single housing may be used to support and at least partially enclosed the components of both printer module 22 and fixer module 24.

Printer 34 comprises a device configured to form an image on face 37 of web 30. In one embodiment, printer 34 deposits printing material onto a face 37 of web 30 as schematically represented by arrows 38. In one embodiment, printer 34 comprises a drop-on-demand inkjet printer. Examples of drop-on-demand inkjet printers include, but are not limited to, a thermoresistive inkjet printer or a piezo resistive inkjet printer. In other embodiments, printer 34 may comprise other print devices configured to deposit a printing material upon face 34 of web 30 or alternatively to selectively treat, change or activate printing material carried by web 30 so as to form an image or pattern upon face 37 of web 30, wherein the printing material cures, dry, solidifies or otherwise changes states in order to achieve substantial permanency (reduced likelihood of smearing, dislocation, color or grayscale alteration and the like).

Web flow path 36 comprise a path formed by one or more stationary or movable structures along which web 30 is guided and moved. In the example illustrated, web flow path 36 guides web 30 from supply roll 32 over and about printer 34 in a first direction 40, back in a second opposite direction 42 across printer 34 and through a print zone of printer 34. Thereafter, web 30 is overturned and moved once again in the direction 40 until being discharged out of housing 33.

In the example illustrated, web flow path 36 is formed by a multitude of rollers 44, 45, 46, 47 and 48 supported by a framework such as provided by housing 33. One or more of rollers 44-48 may be operably coupled to a drive system including a motor so as to be rotationally driven. In the example illustrated, roller 48 is operably coupled to a motor 50 such that roller 40 is rotationally driven to drive web 30. In other embodiments, motor 50 may be omitted or other drive mechanisms may be employed. In other embodiments, print module 22 may include other media guiding members in place of one or more of rollers 44-48. For example, stationary structures such as arcuate panels or plates may be used to guide or direct web 30. In other embodiments, web flow path 36 may include a greater or fewer of rollers 44-48 or other guide members.

As shown by FIG. 1, after face 37 is printed upon, face 37 is no longer contacted by any structure of printer module 22 until being discharged from printer module 22. Roller 48 only contacts the unprinted upon face 52 of web 30 after web 30 has been printed upon by printer 34. No other rollers or other web guiding structures contact face 37 prior to discharge of web 30 from printer module 22. As a result, the freshly printed printing material is less likely to be contacted and smeared or displaced on face 37 of web 30.

Fixer module 24 comprises an arrangement of components configured to treat printing material upon face 37 of web 30 by printer 34 of printer module 22. In other embodiments, fixer module 24 may be used with other printer modules or may be incorporated as a single non-modular arrangement including printer 34. As will be described hereafter, fixer module 24 provides an elongated path of travel for the freshly printed media as the printed material upon face 37 is dried, provided time to cure or otherwise treated before face 37 is initially contacted by one or more media guide members. The elongated path provided by fixer module 24 is relatively compact and does not occupy substantial volume, permitting fixer module 24 to occupy less floor space.

Fixer module 24 includes housing 53, media treatment devices 56 and web flow path 58. Housing 53 comprises one or more structures configured to serve as a framework for supporting the remaining components of fixer module 24. Housing 53 further at least partially encloses the components of fixer module 24. In the example illustrated, housing 53 provides fixer module 24 with its modularity, enabling fixer module 24 to be separated from printer module 22 without damage to fixer module 24 or printer module 22 and without reconfiguring of either printer module 22 or fixer module 24. In other embodiments where fixer module 24 is not modular, housing 53 may also enclose the internal components a printer module 22. Housing 53 may also be omitted where housing 33 also encloses and supports the internal components of fixer module 24.

Media treatment devices (MTDs) 56 comprise devices configured to treat web 30 so as to convert or change the freshly printed printing material upon face 37 from a less permanent state to a more permanent state which is more resistant to smearing, dislocation or other damage that may result from contact with the printing material. For example, in the embodiment illustrated where printing material comprises a fluid having ingredients that may be evaporated to increase the permanency of the printing material upon web 30, devices 56 comprise dryers. Examples of such dryers include, but are not limited to, radiant heaters, convection heaters, microwave heaters or other heating devices. Such dryers may alternatively comprise fans and blowers directing air onto surface 37. In one embodiment, such devices 56 are configured to direct heated air towards face 37 as face 37 of web 30 moves along web flow path 58.

In other embodiments, other types of heaters or other types of media treatment devices 56 may be employed. For example, in other embodiments, the printing material may be configured to be cured to a more permanent state in response to being irradiated by ultraviolet light. In such circumstances, media treatment devices 56 may be configured to emit or direct ultraviolet light onto face 37 as web 30 moves along media flow path 58. In still other embodiments, media treatment devices 56 may be omitted, wherein the printing materials upon face 37 change from a first permanent state to a second more permanent state upon elapse of time.

Web flow path 58 comprises an arrangement of one or more structures configured to guide and direct movement of web 30 through fixer module 24 and relative to media treatment devices 56. Web flow path 58 guides web 30 along bowed paths extending through at least three consecutive turns in a same direction immediately following print module 22 and prior to any contact with the printed upon face 37. In the example illustrated, after web 30 has entered housing 53, web flow path 58 directs web 30 through turns 60, 62, 64, 66 and 68, each of which is in a clock-wise direction as seen in FIG. 1. As a result, face 37 of web 30 remains on the outside of the path 58 and is not contacted by any media guide members or structures. Consequently, the printing material along face 37 is permitted to change states to a more permanent state, less susceptible to smearing, damage or other alteration. Because web flow path 58 overlaps itself, the overall length of travel for the web is relatively large as compared to the floor space or volume occupied by fixer module 24, allowing more time for drying or other treatment of the web. At the same time, because web flow path 58 is bowed between such consecutive turns in the same direction, enhanced wrap of the web about and along the intermediate guides (such as the rollers shown) is enhanced, further enhancing transverse tracking of the web along such guides. Such transverse tracking is especially beneficial in fixer module 24 since the length of the path is elongated and undergoes multiple turns.

In the example illustrated, media treatment devices 56 are located along path 58 between each of turns 60, 62, 64, 66 and 68 as well as between turns 68 and the next successive turn to facilitate this change to a more permanent state. In the example illustrated, the previous wet printing material upon face 37 is completely dried or sufficiently dried to achieve a more permanent state. Although media flow path 58 is illustrated as having five consecutive turns in a same direction prior to any contact with face 37, in other embodiments, media flow path 58 may alternatively include fewer turns, such as three turns or four turns or more than five turns. In other embodiments, media flow path 58 may alternatively comprise at least three consecutive turns in a counter-clockwise direction immediately following receipt from a printer or print module and prior to any contact with the printed upon face of the web.

After moving web 30 through the final clockwise turn 68, web flow path 58 backs out of or retraces the previous winding path by moving or guiding web 30 through at least three consecutive turns in an opposite direction. In the example illustrated, Web flow path 58 guides web 30 through at least N−1 consecutive turns in the opposite direction, wherein N equals the number of turns taken in the same direction immediately following receipt from printing module 22. In the example illustrated, web flow path 58 guides web 30 through at least four consecutive turns in the counter-clockwise direction. In the example illustrated, web flow path 58 guides web 30 through turns 70, 72, 74 and 76 prior to exiting the winding path. As shown by FIG. 1, web flow path 58 further directs web 30 through turns 78, 80, 82 and 84 around the inter-winding portion of path 58 prior to discharge from housing 53 of fixer module 24. Because web flow path 58 further directs web 30 about turns 78, 80, 82 and 84, web 30 may be discharged from treatment module 24 on an opposite side of housing 53 as the point where web 30 enters module 24. As a result, module 24 may be employed in a serial arrangement of modules forming printing system 20. In other embodiments, web 30 may alternatively omit turns 78-84 and may be discharged from module 24 at other points or along other sides of housing 53.

In the example embodiment illustrated, web flow path 58 is formed from a series of rollers including turn rollers 86 and intermediate support rollers 88. Turn rollers 86 are located at each of turns 6084, wherein the web 30 at least partially wraps about such turn rollers as it changes direction. Intervening rollers 88 are located between turn rollers 86 and support web 30 between such turns.

As further shown by FIG. 1, some of turn rollers 86 may additionally be driven to assist in driving web 30. In the example illustrated, turn roller 86 at turn 70 is operably coupled to a motor 90 such that turn roller 86 is rotationally driven. Similarly, turn roller 86 at turn 84 is operably coupled to a motor 92 so as to be rotationally driven to assist in driving web 30. In the particular embodiment illustrated, additional pinch rollers, such as pinch roller 94, may be additionally provided opposite to one or more the driven rollers to assist in driving the web. Although module 24 is illustrated as having depicted number of turn rollers 86, intervening rollers 88 and controllers 94, in other embodiments, module 24 may have a greater or fewer of such turn rollers 86, a greater or fewer number of such intervening rollers 88 and a greater or fewer number of such pinch rollers 94. In still other embodiments, media flow path 58 may include other types of web guiding members or structures or combinations of different types of web guiding structures. For example, in lieu of rollers 86, 88 and 94, web flow path 58 may include arcuate and flat plates or guides, rotatable ball bearings or other structures that guide and facilitate movement of web 30 along predetermined paths. In some embodiments, additional web guide members, such as additional rollers, may be provided generally opposite to corresponding rollers beginning at turn 70.

Controller 26 comprises one or more processing units configured to direct the operation of fixer module 24. For purposes of this application, the turn "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 26 may be embodied as part of one or more application-specific integrated circuits (ASICs). Unless otherwise specifically noted, the controller is not limited to any specific combination of hardware circuitry and software, nor to any particular source for the instructions executed by the processing unit.

In the example illustrated, controller 26 generates control signals which direct a printing of an image upon face 37 by printer 34, which direct the operation of media treatment devices 56 and which to direct the speed at which web 30 is moved through modules 22 and 24 using motors 50, 90 and 92. Such control signals are transmitted either in a wired fashion or wirelessly. In the example illustrated, controller 26 communicates such control signals to both modules 22 and 24. In one embodiment, controller 26 may be provided as part of module 22. In another embodiment, controller 26 may be provided as part of module 24. In yet another embodiment, controller 26 may comprise a separate unit.

Figure 2:
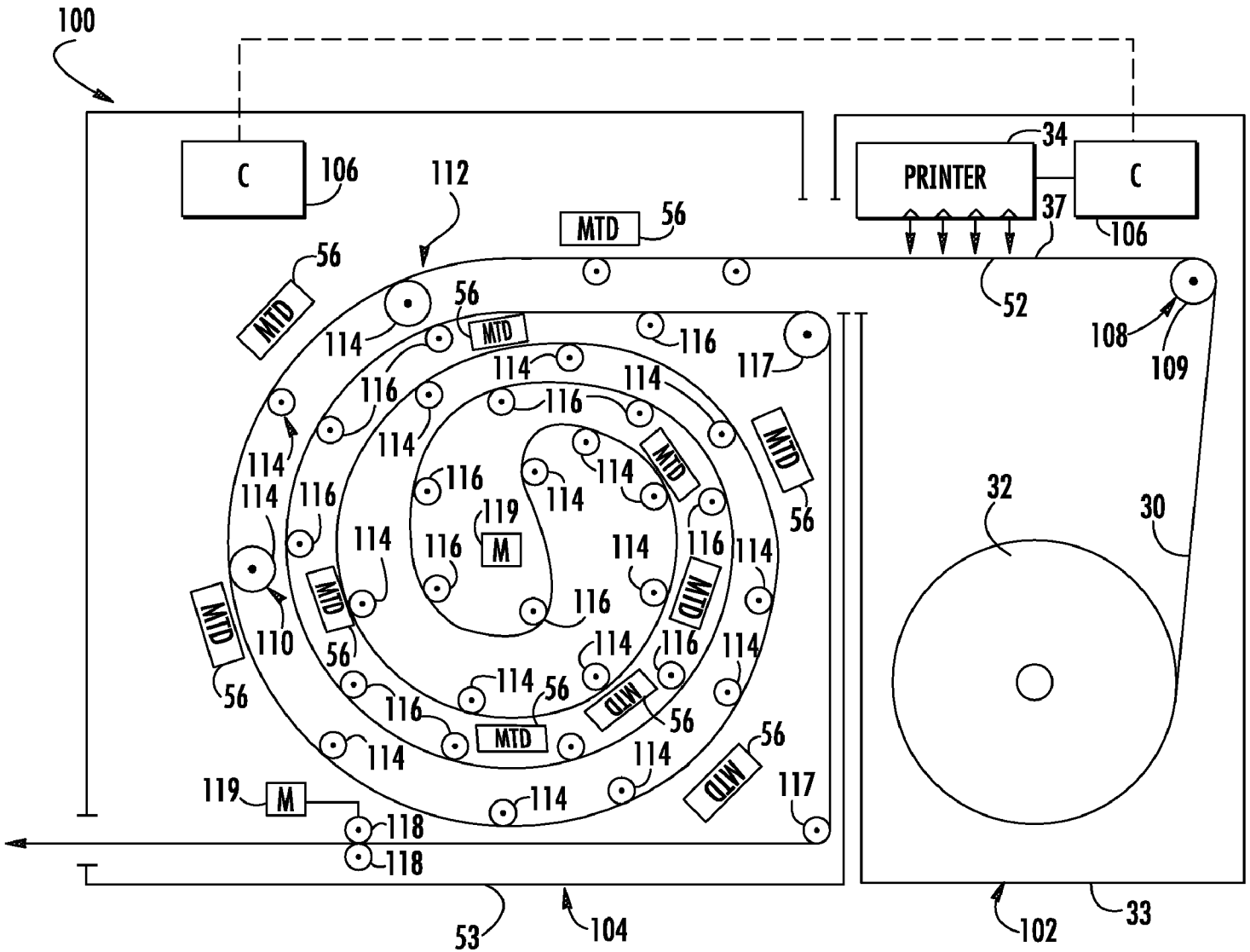
FIG. 2 is a schematic illustration of another embodiment of the printing system of FIG. 1 according to an example embodiment.

FIG. 2 schematically illustrates a printing system 100, another embodiment of printer system 20. Like printing system 20, printing system 100 prints an image upon a face of a web of media and subsequently treats the web such that the printed image attains a more permanent nature or state prior to being initially contacted by one or more media guiding structures or members. Printing system 100 includes printing module 102, fixer module 104 and controllers 106.

Printing module 102 is similar to printing module 22 except that printing module 102 includes web flow path 108 in place of web flow path 36. Those remaining elements of printing module 102 which correspond to elements of printing module 22 are numbered similarly. As shown by FIG. 2, web flow path 108 guides and directs Web 30 from supply roll 32 across and beneath print device 34. In the example illustrated, Web flow path 108 includes roller 109 for guiding web 30. In other embodiments, web flow path 108 may include additional rollers or additional/alternative guiding members or structures that direct or guide movement of web 30.

As with printer 34 of printing module 22, printer 34 of printing module 22 prints or otherwise forms an image upon face 37 of web 30. However, unlike printing module 22, printing module 102 does not overturn web 30 after such printing, but discharges web 30 with the print upon face 37 facing upward and the unprinted upon face 52 facing downward. As noted above, printer 30 may either deposit a printing material upon face 37 or may treat or activate printing material already contained upon web 37. In either case, fixer module 104 treats the printing material to enhance its permanency or steadfastness upon face 37.

Fixer module 104 is similar to fixer module 24 except that fixer module 104 includes web flow path 110 in lieu of web flow path 58. Those remaining elements of fixer module 104 which correspond to elements of fixer module 24 are numbered similarly. Like fixer module 22, fixer module 104 includes multiple media treatment devices 56 along media flow path 110 configured to treat web 30 as it travels along media flow path 110 to increase the permanency or steadfastness of the image and printing material upon face 37 of web 30. In the example illustrated, treatment devices 56 comprise dryers. Such dryers direct heated air towards face 37 to dry fluid printing material upon face 37. In particular embodiments, such dryers may additionally direct heated air towards face 52 of web 30 along the path 110. In other embodiments, devices 56 additionally or alternatively heat the overall ambient air within the chamber formed by housing 53 about web flow path 110. In other embodiments, as discussed above, media treatment device 56 may comprise other devices depending upon the type and form of printing material forming the images, patterns or layers upon web 30.

Web flow path 110 is similar to web flow path 58 except that web flow path 110 has a more circular or spiral shape as compared to the triangular or teepee shape of web flow path 58. As a result, web flow path 110 directs web 30 along a series of multiple more gradual turns rather than the sharp turns of web flow path 58. For purposes of this disclosure, the term "turn" means a deviation from linearity brought about by one or more web guide members. In the example shown in FIG. 2, web flow path 110 begins to make a series of relatively small gradual turns beginning at point 112. In the example illustrated, such small turns are achieved by a multitude of guide members (turn rollers 114) having their axes of rotation circumferentially located about a center point. Overall, web flow path 110 includes 18 consecutive turns in any same direction (counter clockwise) before reaching turn roller 116. Media treatment devices 56 are located along media path 110 formed by turn rollers 114. During travel of web 30 along turn rollers 114 of media flow path or 110, printed upon face 37 is not contacted by any guide structure, allowing the image upon face 37 to have sufficient time to attain a more permanent or steadfast state. Because the spiral path provided by web flow path 110 wraps about itself or overlaps itself in multiple layers, the spiral path provided by web flow path 110 provides this additional time without substantially increasing the volume or floor space required by fixer module 104. Because Web flow path number 110 has a spiral path, the web is gradually guided about multiple turns. This gradual guidance of the web about multiple turns imposes less stress upon the web and is less likely to crease or permanently deform the web.

Because web flow path 110 overlaps itself the overall length of travel for the web is relatively large as compared to the floor space or volume occupied by fixer module 104, allowing more time for drying or other treatment of the web. At the same time, because web flow path 110 is bowed between such consecutive turns in the same direction, enhanced wrap of the web about and along the intermediate guides (such as the rollers shown) is enhanced, further enhancing transverse tracking of the web along such guides. Such transverse tracking is especially beneficial in fixer module 104 since the length of the path is elongated and undergoes multiple turns.

Beginning at turn roller 116, web flow path 110 retraces its spiral path in an opposite direction by extending through multiple consecutive turns in a same direction opposite to that of path 110 along turn rollers 114. In the example illustrated, media flow path 110 has 14 consecutive turns in a clockwise direction before exiting the previously formed spiral.

In the example illustrated, web flow path 110 additionally includes rollers 117 which redirect web 30 about the formed spiral such that web 30 may be discharged from module 104 on an opposite side of module 104 as compared to where web 30 enters module 104. As a result, module 104 may be utilized in a serial or end-to-end arrangement of modules forming a printing system. In other embodiments, rollers 117 may be provided at other locations or may be omitted, wherein web 30s discharge from module 104 at other locations. In other embodiments, web flow path 110 may include other web guiding members or structures other than rollers such as curved plates, which are located on one side of web 30. In particular embodiments, additional web guide members may be provided opposite to turn rollers 116.

As further shown by FIG. 2, fixer module 104 may additionally include components configured to drive web 30 along web flow path 110. In the example illustrated, module 104 additionally includes nip rollers 118 and drive motors 119 for facilitating the driving of web 30 along web flow path 110. Although module 104 is illustrated as having a drive motor 119 operably coupled to the first turn roller 116 along web flow path 110 and as having a drive motor 119 operably coupled to one of nip rollers 118, in other embodiments, fixer module 104 may include drive motors 119 operably coupled other rollers at the same or other locations for driving (pulling) web 30 along web flow path 110. In other embodiments, the actual number of turn rollers 114 and turn rollers 116 as well as their relative spacings may be varied from that shown. In addition, the tightness for compactness of the formed spiral as well as the number of spiral loops may also be varied from that shown.

Controllers 106 comprise one or more processing units configured to direct the operation of printer 34, media treatment devices 56 and drive motors 119. In the example illustrated, printer module 102 and fixer module 104 are each illustrated as having a dedicated controller 106, wherein controllers 106 are in communication with one another, either wirelessly or in a wired fashion, to coordinate the operation of modules 102 and 104. In other embodiments, a single controller 106 may be utilized to control and coordinate the operation of both module 102 and module 104.

Figure 3:
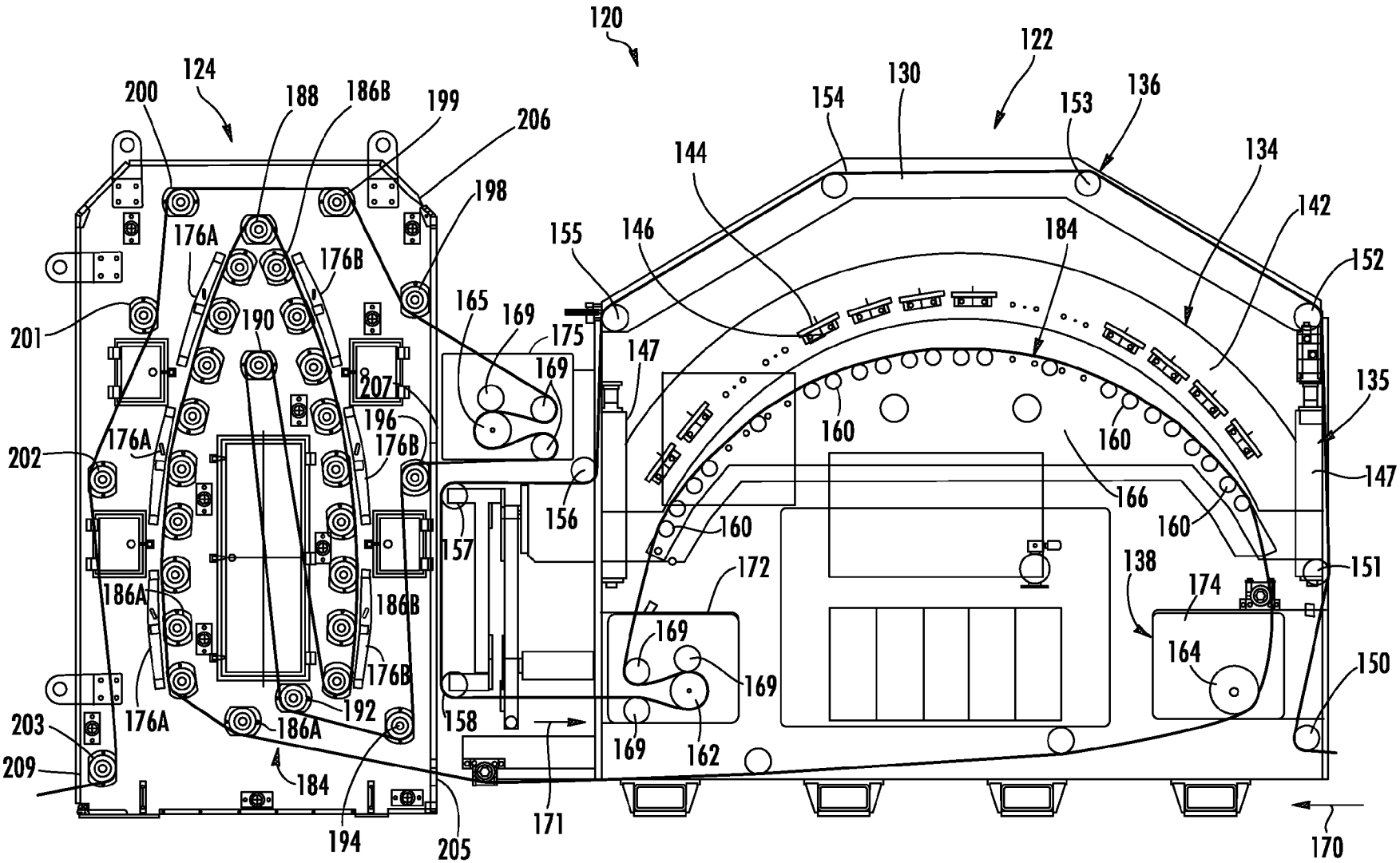
FIG. 3 is a side elevation of view illustrating another embodiment of the printing system of FIG. 1 according to an example embodiment.
Figure 4:
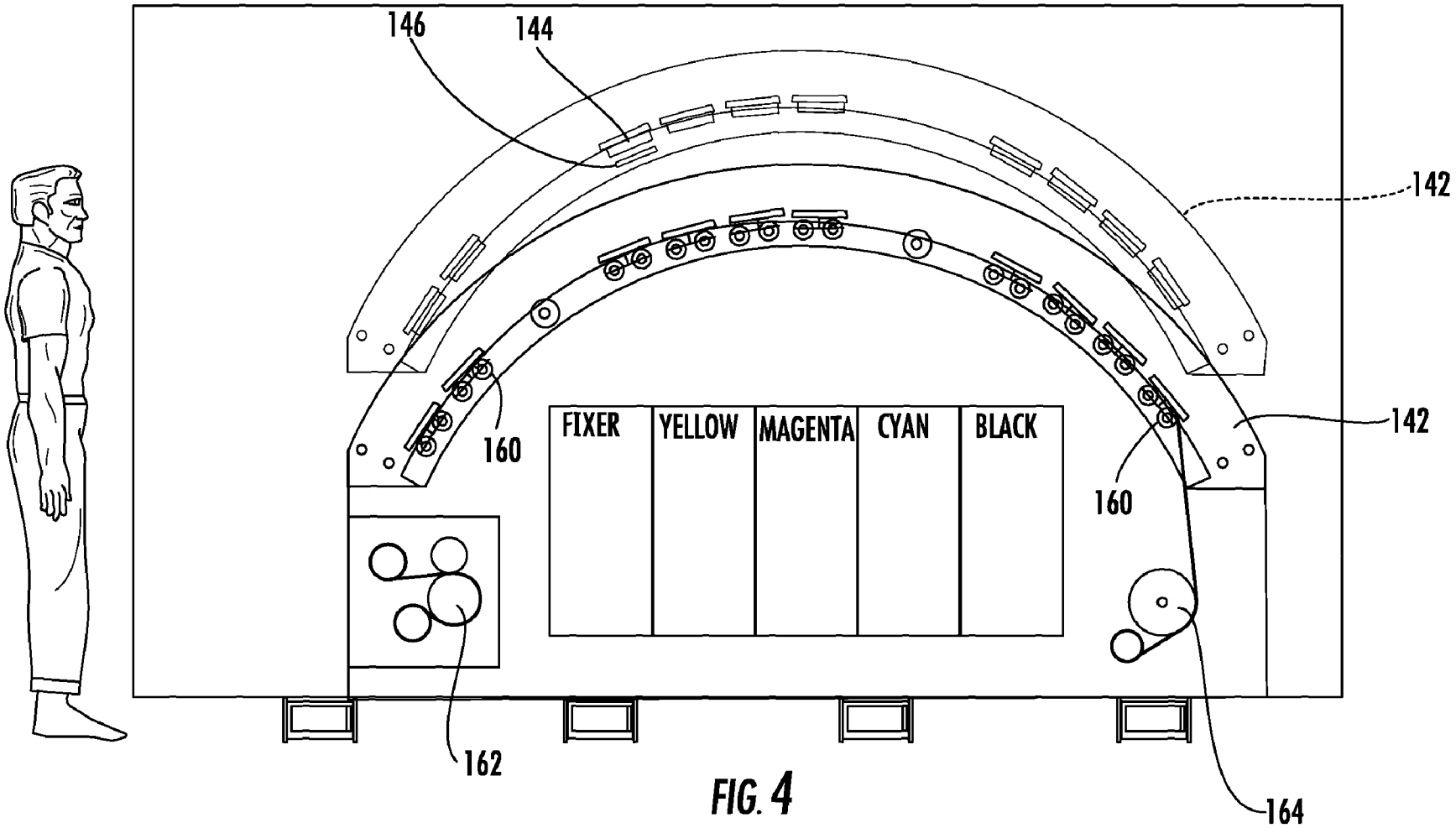
FIG. 4 is a side elevation of view of a print module of the printing system of FIG. 2 illustrating print heads in raised and lowered positions according to an example embodiment.

FIGS. 3 and 4 illustrate printing system 120, another embodiment of printing systems 20 and 100. Like printing systems 20 and 100, printing system 120 is configured to print upon a web of print media. Printing system 120 is further configured to treat the printed image on the web of media such that it has a more permanent or steadfast state more resistant to subsequent contact while having a layout and a web flow path that facilitate occupies less floor space.

As shown by FIG. 3, system 120 includes print module 122 and fixer module 124 and controller 26 (shown in FIG. 1). Print module 22 selectively deposits printing material upon web 130 to form an image, pattern, layout or arrangement of printing material upon web 130. In one embodiment, web 130 may comprise a web of printing material such as by cellulose-based media. In another embodiment, web 130 may comprise a web of polymeric material. In yet another embodiment, web 130 may comprise one or more other materials. In one embodiment, the printing material comprises a fluid such as one or more inks. In yet other embodiments, the printing material may comprise other types of fluid.

Print module 122 includes a printer 134, actuator 135, web flow path 136 and web drive 138. Printer 134 comprises a device or mechanism configured to selectively deposit printing material. Printer 134 includes support 142 and one or more pens or cartridges 144. Support 142 comprises a structure configured to support cartridges 144 opposite to web 130. In the particular example illustrated, support 142 is configured to support cartridges 144 along an arc opposite to web 130. In the embodiment illustrated, support 142 is movable towards and away from web 130. In yet another embodiment, support 142 is stationary opposite to web 30.

Cartridges 144 comprise mechanisms configured to eject fluid onto web 130. In the particular example illustrated, cartridges 144 each include one or more print heads 146 (schematically shown on one of cartridges 144). In one embodiment, print heads 146 each comprise thermal resistive drop-on-demand inkjet print heads. In yet other embodiments, print heads 146 may comprise piezo resistive inkjet print heads. In still other embodiments, print heads 146 may comprise other mechanisms configured to eject fluid in a controlled manner.

According to one embodiment, cartridges 144 each include a self-contained reservoir of fluid which is applied to the associated print heads 146. In yet another embodiment, cartridges 144 each include a reservoir which is further supplied with fluid or ink via an off-axis ink supply system using one or more pumps or other mechanisms to supply a fluid to each of cartridges 144. In one embodiment, cartridges 144 of printer 134 are configured to apply multiple colors of ink. In the embodiment illustrated, cartridges 44 configured to deposit black (K), cyan (C), magenta (M) and yellow (Y) colored inks. In the example illustrated, printer 34 is additionally configured to apply a fixer (F) to web 130 prior to application of the colored inks. In other embodiments, printer 134 may include a fewer or greater number of such cartridges configured to apply a fewer or greater number of such different types of fluid.

Actuator 135 comprise a mechanism configured to selectively raise and lower support 142 to raise and lower cartridges 144 relative to web flow path 136 and web 130. As a result, support 142 may be moved to facilitate enhanced access to cartridges 44 for inspection, repair or replacement. In some embodiments, movement of support 142 and cartridges 144 may further facilitate servicing of print heads 146.

In the embodiment illustrated, actuator 135 comprises one or more hydraulic or pneumatic cylinder assemblies 147. In another embodiment, actuator 135 comprises one or more electric solenoids. In the yet another embodiment, actuator 135 may comprise one or more cams driven by one or more motors. In such an embodiment, support 142 may be guided by one or more guide rods or other guide structures. In still other embodiments, actuator 135 may be omitted.

Web flow path 136 comprises a path formed by one or more stationary or movable structures along which web 130 is guided and moved. In the particular example illustrated, web flow path 136 is formed by overhead rollers 150, 151, 152, 153, 154, 155, 156, 157 and 158, arcuately arranged rollers 160 and control rollers 162, 164, 166. Rollers 150-158 guide and direct web 130 along path 36 over, around and about print support 42 and cartridges 44 generally to control roller 162. Although path 136 is illustrated as utilizing rollers 150-158 for directing web 130 over and around support 142, in other embodiment, path 136 may include a greater or fewer of such rollers for directing web 130 around support 142. In still other embodiments, other structures may be used to guide web 130 over and around support 142. For example, stationary structures such as arcuate panels or plates may be used to guide or direct web 130 around support 142.

Arcuately arranged rollers 160 comprise a series of rotationally supported cylinders or rollers supported in an arc by a support 166 opposite to support 42 and cartridges 144. In one embodiment, support 166 supports rollers 160 which rotate about their individual axes. Rollers 160 facilitate relatively smooth movement of web 130 with minimal friction upon web 130. In other embodiment, rollers 160 may include a greater or fewer of such rollers or may include other structures configured to support web 130 in an arc opposite to support 142. For example, in another embodiment, rollers 160 may be replaced with one or more arcuate platens or plates.

Control rollers 162, 164 comprise independently rotationally driven rollers which define or form web flow path 136 and which move web 130 along web flow path 136. Roller 162 is located immediately upstream of cartridges 144 and their associated print heads 146. Roller 164 is located immediately downstream of cartridges 144 and their associated print heads 146 along web flow path 136. Rollers 162 and 164 form or define a printing zone across support 166 and rollers 160. Rollers 162 and 164 are configured to be driven at different speeds, facilitating adjustment of the tension of web 130 across an opposite to cartridges 144 during printing upon web 30. At the same time, rollers 162 and 164 may be driven at substantially the same speed, facilitating precise velocity control of web 130 across the printing zone formed by rollers 162, 164 and rollers 160.

Control roller 166 comprises an independently rotationally driven roller which further partially defines web flow path 136. Control roller 165 engages or contacts web 130 after web 130 has left printer module 122 and has passed through fixer module 124. In operation, control roller 165 pulls web 130 partially through fixer module 124 despite being physically associated with printer module 122. Because printer module 122 includes control roller 165, the cost and complexity of media treatment module 124 is reduced. Likewise, control of the velocity of control roller 165 may be more easily facilitated using controller 26 (shown and described with respect to FIG. 1) which is also physically associated with print module 122. In other embodiment, control roller 165 may alternatively be provided as part of fixer module 124.

As further shown by FIG. 3, each of control rollers 162 and 166 is preceded and succeeded by additional guide rollers 169. Guide rollers 169 facilitate wrap of web 130 about control rollers 162 and 165. In other embodiment, such additional guide rollers 169 may be omitted.

As further shown by FIG. 3, web flow path 136 is inverted multiple times. In particular, when entering print module 122, web flow path 136 is flowing in a first direction as indicated by arrow 170. At roller 158, the direction in which web 130 is moving is inverted such that web 130 is redirected and moves in a second opposite direction as indicated by arrow 171. Web flow path 136 continues in an arc over rollers 160 opposite to cartridges 144 until it is once again inverted at roller 164 to once again flow in the direction indicated by arrow 170. Web flow path 136 continues to flow "downstream" in the direction indicated by arrow 170 until leaving print module 122 for a first time prior to reentering print module 122 at control roller 165.

Web drive 138 comprises one or more mechanisms configured to rotationally drive rollers 162, 164 and 165. In the example illustrated, web drive 138 comprises servo motors 172, 174 and 175 (with associated encoders). In other embodiments, web drive 138 may comprise other controllable sources of torque. In still other embodiments, web drive 138 may comprise a single motor configured to selectively supply distinct levels of torque or velocity to rollers 162, 164 and 165 using one or more transmissions and clutch mechanisms.

Fixer module 124 comprises an arrangement of components configured to treat printing material that is deposited upon web 130 by printer 134 of printer module 122 such that it attains a more permanent or steadfast characteristic or state, wherein the printing material is less susceptible to smearing, scratching, damage or alteration when being contacted or pressed upon. Fixer module 124 includes media treatment devices 176A, 176B (collectively referred to as media treatment devices 176) and web flow path 178. In the example illustrated, media treatment devices 176 comprise devices configured to dry printing material upon web 130. In one embodiment, media treatment devices 176 comprise devices configured to blow heated air onto one or more faces of web 130. In another embodiment, heaters 176 may additionally or alternatively apply infrared heat or other forms of the heat or energy, such as microwaves, to dry the printing material upon web 130.

In the particular example illustrated, media treatment devices 176 includes one or more media treatment devices 176 substantially facing in direction 170 and one or more media treatment device 176 substantially facing in direction 171, wherein web flow path 178 guides web 130 between such opposite media treatment devices 176 with the printed upon face of web 130 facing outwardly towards each of the opposed sets of one or more media treatment devices 176. In addition, as with media treatment device 76, media treatment devices 176 are substantially vertical. Thus, fixer module 124 and system 120 are more compact and occupy less floor space.

Web flow path 178 comprises an arrangement of one or more structures configured to guide and direct movement of web 130 through fixer module 124 and relative to media treatment devices 176. Web flow path 178 includes guide rollers 186A, 186B (collectively referred to as guide rollers 186), inverter roller 188, return roller 190, exit rollers 192, 194 and 196, and reentry and discharge rollers 198, 199, 200, 201, 202 and 203. Guide rollers 186A direct web 130 from fixer module input opening 205, in the outer enclosure or housing 206, across and opposite to media treatment devices 176A with the printed upon face 184 of web 130 facing media treatment devices 176A. Likewise, guide rollers 176B guide and direct movement of web 130 opposite to media treatment devices 176B with face 184 facing media treatment devices 176B. Inverter roller 188 is located between rollers 186A and 186B. Web 130 wraps approximately 180 degrees about roller 188 as it changes direction from an upward direction when moving across media treatment device 176A to a substantially downward direction when moving across media treatment device 176B. Because web 130 is directed in this up-and-down vertical path, fixer module 124 more effectively dries web 130 with fixer module 124 occupying less floor space. Because web flow path 178 guides movement of web 130 through at least three consecutive turns in a same direction immediately succeeding receipt of web 130 from print module 122, the printed upon face of web 130 is provided greater time for drying and for achieving a more permanent or robust state prior to being contacted.

Because web flow path to 178 overlaps itself, the overall length of travel for the web is relatively large as compared to the floor space or volume occupied by fixer module 124, allowing more time for drying or other treatment of the web. At the same time, because web flow path for 178 is bowed between such consecutive turns in the same direction, enhanced wrap of the web about and along the intermediate guides (such as the rollers shown) is enhanced, further enhancing transverse tracking of the web along such guides.

Such transverse tracking is especially beneficial in fixer module 124 since the length of the path is elongated and undergoes multiple turns.

Return roller 190 comprises a rotationally supported roller between rollers 186A and 186B. As shown by FIG. 3, web 130 wraps about the last of rollers 186B and once again extends upwardly until wrapping about roller 190. After wrapping about roller 190, web 130 directed vertically downward across roller 192, around roller 194 and outward after being guided by roller 196. Return roller 190 enables web 130 to once again pass between opposed heaters 176A and 176B for further heating and further drying. Thereafter, rollers 192-196 direct web 130 out discharge opening 207 formed in the outer enclosure or housing 206 of fixer module 124.

As shown by FIG. 3, web 130 is then directed from roller 196 about control roller 165 associated with printer module 122. After being driven by control roller 165, web 130 reenters web flow path 178 of fixer module 124. Rollers 198-203 guide and direct web 130 over and around media treatment devices 176 down to a second discharge opening 209 in housing 206. Web 130 is discharge from fixer module 124 in substantially the same direction arrow 170 at which web 130 entered print module 122 of system 120. Consequently, web flow paths 136 and 178 enable system 120 to print and dry web 130 in an effective manner while occupying less floor space. Because web flow path 178 as a general teepee shape (a height at least greater to base and nominally two or more times greater than the base), the floor space occupied by fixer module 124 is even further reduced. In other embodiments, web flow path 178 may have other configurations.

Although fixer module 124 is illustrated as utilizing the illustrated serpentine web flow path 178 using the noted rollers, in another embodiment, fixer module 124 may utilize other serpentine web flow paths. In another embodiment, fixer module 124 may include other arrangements of rollers. In other embodiments, fixer module 124 may include other types of guides for guiding web 130 and directing movement of web 130 through fixer module 124. In some embodiments, fixer module 124 may include other types of media treatment devices or media treatment devices differently arranged within fixer module 124.

In operation, controller 26 (shown in FIG. 1) generates control signals directing motors 172, 174 and 175 to rotationally drive control rollers 162, 164 and 165, respectively, so as to control the tension and velocity of web 130. In particular, controller 26 generates control signals controlling the application of torque provided by rollers 162 and 164 to control the velocity and positioning of web 130 across rollers 160 opposite to print heads 146 of cartridges 144. At the same time, controller 26 generates control signals directing actuator 135 to position cartridges 144 into close proximity to face 184 of web 130. Controller 128 generates control signals directing fluid or printing material, such as ink, to be ejected onto face 184 by print heads 146.

Controller 26 also generates control signals controlling the amount of heat provided by media treatment devices 176. At the same time, controller 26 generates control signals directing motor 175 to rotationally drive control roller 165 to control the tension and velocity of web 130 through fixer module 124. In one embodiment, controller 26 may be configured to operate in different modes at different times based upon command received via an input 26 or based upon instructions contained in an associated computer readable medium or memory. For example, in one embodiment, controller 26 may initially adjust the tensioning of web 130 by causing rollers 162 and 164 to be driven a different velocities. Once an appropriate tension has been set, controller 26 may generate control signals causing rollers 162, 164 to be driven at substantially the same velocity contribute control positioning of web 130 during printing. As web 130 is being moved through system 120, controller 26 may also generate control signals causing rollers 165 to be driven at a speed or velocity distinct from rollers 162 164. As a result, controller 26 may control the tension of the web 130 as it is being dried. This tension may be different from the tension of the web 130 across the print's own (across rollers 160 and opposite to cartridges 144).

At certain points in time, cartridges 144 or their print heads 146 may be repaired, replaced or serviced. At such times, controller 26 may generate control signals causing actuators 135 to raise or lift support 142 and cartridges 144 away from rollers 160 and that portion of web flow path 136 between rollers 160 and cartridges 144. FIG. 3 illustrates support 142 in a raised, servicing position as compared to the lowered, deployed and printing position. Consequently, system 120 enables access to print heads 146 from both above and below for replacement and servicing.

As shown in FIG. 3, printer module 122 and fixer module 124 comprise separate and distinct modules contained in separate and distinct enclosures or housings, wherein such modular positioned in close proximity or adjacent to one another to facilitate transfer of web 130 therebetween. Because system 120 includes distinct modules 122, 124, printer module 122 may be used independently of fixer module 124 either by itself or with other fixer modules. Likewise, fixer module 124 may be used independently of printer module 122. In other embodiments, the components of print modules 122 and fixer module 124 may alternatively be house are contained within a single enclosure or housing.

Figure 5:
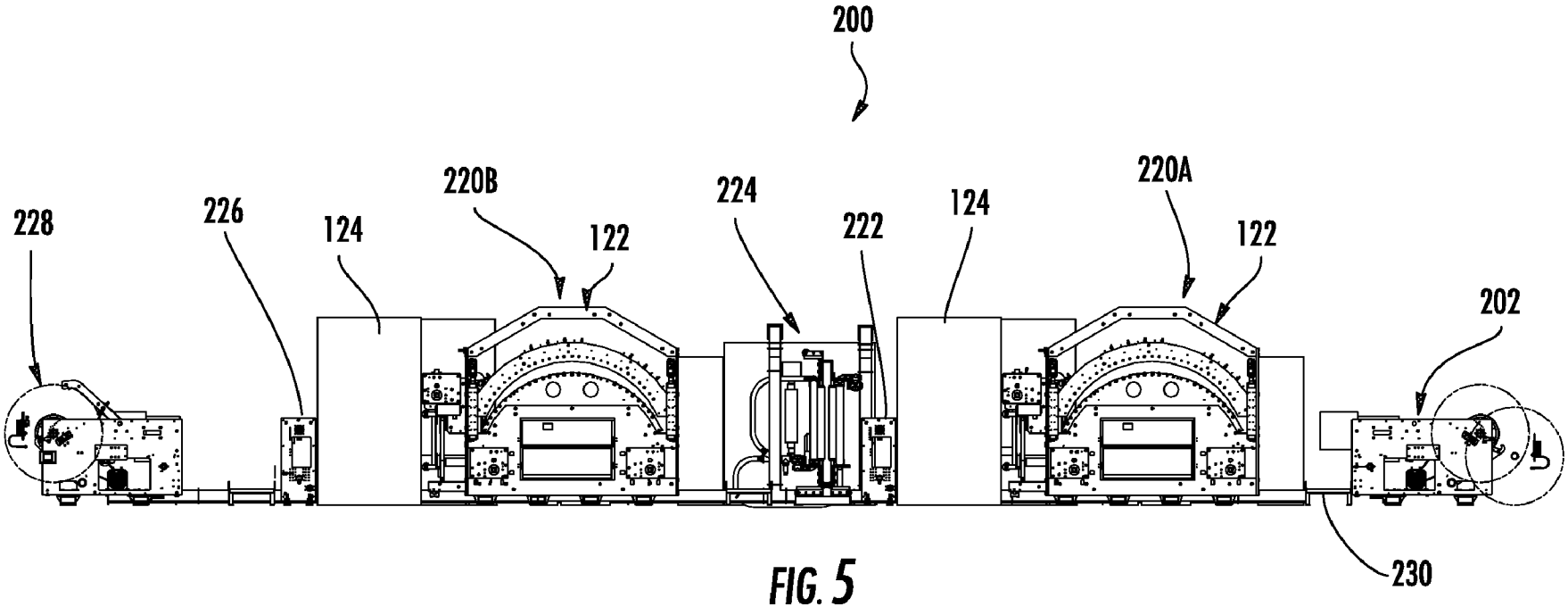
FIG. 5 is a side elevation of view of a duplexer system according to an example embodiment.

FIG. 5 schematically illustrates the duplexing system 200. Duplexing system 200 is configured to print upon opposite sides of a web of media. Duplexing system 200 includes web supply 202, printing systems 220A, 220B (collectively referred to as printing systems 220), sensors 222, web inverter 224, sensors 226 and web collection 228. Web supply 200 comprises a supply of web 230 which is unwound and delivered to printing system 220A across a walkway or intermediate platform 230.

Printing systems 220 are each identical to printing system 120 (shown and described with respect to FIGS. 3 and 4). In particular, each printing system 220 includes a print module 122 and a fixer module 124. Printing system 220A receives a web of media and prints upon a first face of the web in print module 122. The first face of the web is dried in fixer module 124 of system 220A.

Sensor 222 comprises one or more sensors configured to detect quality and accuracy of the image printed upon the first face of the web. In one embodiment, sensor 222 comprises a vision system, such as a video or camera system, configured to sense or detect quality and accuracy of the image printed upon the web. Sensor 222 is located between fixer module 124 of system 220A and web inverter 224. Sensor 222 senses the first face of the web as it passes between system 220A and inverter 224. Sensor 222 transmits signals communicating the sensed results to controller 26 (shown in FIG. 1) which adjusts the operation of the various components of duplexing system 220 based upon such results.

Web inverter 224 comprise a mechanism configured to invert, flip or turn over the web of printing material such that system 220B prints upon a second opposite face of the same web. In the example embodiment illustrated, inverter 224 comprises an air driven turn bar or turn unit commercially available from EMT International located in Green Bay, Wis. or Hunkeler AG. In other embodiments, web inverter 124 may comprise other mechanisms or devices between systems 220A and 220B that configured to flip or overturn a web of media.

Printing system 220B receives the overturned web and prints upon the second opposite side of the web using print module 122. Fixer module 124 dries the second opposite side of the pages that have been printed upon. Thereafter, the web, having been printed on both sides, is discharged and rewound by web collector 228.

In the example illustrated, duplexing system 200 includes sensor 226 between printing system 220B and web collector 228. As with Sensor 222, sensor 226 senses, detects or verifies the quality or accuracy of the printed image upon the second side of the web. Sensor 226 transmits are communicates signals communicating the results to controller 26 (shown in FIG. 1) which adjusts operating parameters based upon the sense results. For example, in response to signals from sensor 222, controller 26 may adjust the velocity of the web, the tension of the web, the spacing or positioning of support 142 and cartridges 144 relative to the web or printing parameters of print heads 146, or the output of media treatment devices 176 of print system 220A. Likewise, in response to signals from sensor 226, controller 26 may adjust the velocity of the web, the tension of the web, the spacing or positioning of support 142 and cartridges 144 relative to the web, the printing parameters of print heads 146, or the output of media treatment devices 176 of print system 220B. In other embodiments, one or both of sensors 222, 226 may be omitted.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

one or more media treatment devices; and a web flow path adapted to extend from a printing device and having bowed segments extending between at least three consecutive turns in a first rotational direction immediately following the printing device, wherein the web flow path has a teepee shape having a first side segment and a second side segment converging at an upper vertex of the teepee shape, the first side segment and the second side segment extending from base corners of the teepee shape formed by two of the at least three consecutive turns;

a first media treatment device facing inwardly in a first inward direction to face a face of the web along the web flow path; and a second media treatment device facing inwardly in a second inward direction to face the face of the web along the web flow path, wherein the first side segment of the web flow path is configured to support a printed upon face of the web outwardly towards the first media treatment device, wherein the second side segment of the web flow path is configured to support the printed upon face of the web outwardly towards the second media treatment device and wherein the web flow path extends within the teepee shape between the first side segment and the second side segment where the flow path turns in a second rotational direction opposite to the first direction prior to exiting through a base of the teepee shape.

2. The apparatus of claim 1 further comprising one or more rollers forming one or more of the at least three consecutive turns.

3. The apparatus of claim 1 further comprising a housing defining a chamber containing the first media treatment device and the second media treatment device, wherein the at least three consecutive turns are contained in the chamber.

4. The apparatus of claim 3, wherein the housing includes a first input opening and a first output opening.

5. The apparatus of claim 4, wherein the housing includes a second input opening and a second output opening and wherein the apparatus further comprises a drive roller external to the housing, wherein the web path extends into the housing through the first input opening and extends out the housing through the second output opening into engagement with the drive roller, wherein the web path extends back into the housing through the second input opening and out the housing through the first output opening.

6. The apparatus of claim 4, wherein the first input opening is on a first side of the housing and wherein first output opening is on a second opposite side of the housing.

7. The apparatus of claim 1 further comprising a plurality of rollers along the web flow path between consecutive turns.

8. The apparatus of claim 1, wherein the first segment of the web flow path is configured to move the web in a first direction between consecutive turns and wherein the second segment of the web flow path is configured to move the web in a second substantially opposite direction between consecutive turns and wherein the first segment of the web flow path and the second segment of the web flow path face one another.

9. The apparatus of claim 1 further comprising the printing device, wherein the printing device is configured to print an image on a first face of the media and wherein the web flow path is configured such that a second opposite face of the media is contacted during each of the at least three consecutive turns in the same direction.

10. The apparatus of claim 1, wherein the flow path has a horizontal base having a width and a vertical height greater than the width.

11. A method comprising:

moving a web of media from a print device along bowed vertical segments of a web flow path about at least three consecutive turns in a first rotational direction, wherein the least three consecutive turns are enclosed in a housing and wherein the web of media contains wet imaging material after a first one of the at least three consecutive turns; and drying the web of media as it is moved about the at least three consecutive turns, wherein drying the web of media comprises treating the web of media with a first media treatment device facing inwardly in a first inward direction and facing the web along a first segment of the web flow path extending between two of the at least three consecutive turns;

treating the web of media with a second media treatment device facing inwardly in a second inward direction facing the web along a second segment of the web flow path extending between two of the at least three consecutive turns while the first segment of web flow path supports a printed upon face of the web outwardly towards the first media treatment device and while the second segment of the web flow path supports the printed upon face of the web outwardly towards the second media treatment device;

turning the web of media in a second rotational direction about a horizontal axis between the first segment of the web flow path and the second segment of the web flow path;

guiding the web from inside the housing to outside the housing;

driving the web while outside the housing after the web has moved from inside the housing to outside the housing; and guiding the web back into the housing.

12. The method of claim 11, wherein the web of media is moved about the at least three consecutive turns in a heated chamber to dry the web media.

13. The method of claim 11, wherein the web of media is moved partially about one or more rollers forming one or more of the at least three consecutive turns.

14. The method of claim 11 further comprising forming an image upon a first face of the web, wherein a second opposite face of the web is contacted during each of the at least three consecutive turns in the same direction.

* * * * *

UNITED STATES PATENT AND TRADEMARK OFFICE

CERTIFICATE OF CORRECTION

PATENT NO. : 8,348,531 B2
APPLICATION NO. : 12/258762
DATED : January 8, 2013
INVENTOR(S) : John W. Godden et al.

It is certified that error appears in the above-identified patent and that said Letters Patent is hereby corrected as shown below:

In column 14, line 22, in Claim 5, before "out" insert -- extends --.

In column 14, line 48, in Claim 11, before "least" insert -- at --.

Signed and Sealed this
Second Day of April, 2013

Teresa Stanek Rea
*Acting Director of the United States Patent and Trademark Office*